US009392912B2

(12) United States Patent
Haddad

(10) Patent No.: US 9,392,912 B2
(45) Date of Patent: Jul. 19, 2016

(54) DUAL COMPARTMENT WALK-IN BATHTUB

(71) Applicant: Theodore Haddad, Danbury, CT (US)

(72) Inventor: Theodore Haddad, Danbury, CT (US)

( * ) Notice: Subject to any disclaimer, the term of this patent is extended or adjusted under 35 U.S.C. 154(b) by 113 days.

(21) Appl. No.: 14/058,323

(22) Filed: Oct. 21, 2013

(65) Prior Publication Data

US 2014/0115771 A1 May 1, 2014

Related U.S. Application Data

(60) Provisional application No. 61/719,120, filed on Oct. 26, 2012.

(51) Int. Cl.

| | |
|---|---|
| ***A47K 3/14*** | (2006.01) |
| ***A47K 3/022*** | (2006.01) |
| ***A47K 3/00*** | (2006.01) |

(52) U.S. Cl.

CPC ..... *A47K 3/022* (2013.01); *A47K 3/006* (2013.01); *A47K 3/14* (2013.01)

(58) Field of Classification Search

CPC ..... A47K 3/006; A47K 3/14
USPC ..... 4/555, 556, 539, 514, 654
See application file for complete search history.

(56) References Cited

U.S. PATENT DOCUMENTS

| | | | | |
|---|---|---|---|---|
| 211,856 | A * | 2/1879 | Koch | 4/514 |
| 4,264,991 | A * | 5/1981 | Lasalandra | 4/514 |
| 5,343,576 | A * | 9/1994 | Dannenberg et al. | 4/590 |
| 5,423,095 | A * | 6/1995 | Bearer | 4/514 |
| 7,299,509 | B1 | 11/2007 | Neidich | |
| 7,690,701 | B2 | 4/2010 | Van Ravenhorst | |
| 8,375,478 | B2 | 2/2013 | Luo | |
| 2005/0102746 | A1 | 5/2005 | Wright et al. | |
| 2010/0263119 | A1 | 10/2010 | Neidich et al. | |

* cited by examiner

*Primary Examiner* — Huyen Le
(74) *Attorney, Agent, or Firm* — Daniel Boudwin; Global Intellectual Property Agency

(57) ABSTRACT

A bathtub is provided of the walk-in type, wherein the bathtub includes an internal dam element that allows a user to segment the bathtub into a first and second compartment and operably utilize the bathtub as a sit-down tub or as a standing shower. An entry door provides access into the bathtub without requiring users to lift their legs during entry, while the dam element allows the user to fill the first compartment of the tub and prepare it for use before entering the bathtub interior. The second compartment remains empty as the first compartment fills with water, whereafter the user can enter the empty second compartment and remove the dam element after closing the entry door. The bathtub further comprises a first and second drain for independently draining the first and second compartments and allowing the user to exit the tub while the first compartment is still draining.

11 Claims, 8 Drawing Sheets

DUAL COMPARTMENT WALK-IN BATHTUB

CROSS REFERENCE TO RELATED APPLICATION

This application claims the benefit of U.S. Provisional Application No. 61/719,120 filed on Oct. 26, 2012, entitled "Walk-in Bathtub." The above identified patent application is herein incorporated by reference in its entirety to provide continuity of disclosure.

BACKGROUND OF THE INVENTION

1. Field of the Invention

The present invention relates to walk-in bathtubs for those with reduced mobility that allow for pre-filling thereof prior to entry. More specifically, the present invention pertains to a walk-in bathtub that allows a user to fill the tub without being positioned therein while having the entry door in an open position. The device facilitates setting the bathtub as would be possible with a traditional tub, whereafter the user can enter the bathtub without climbing over the bathtub wall.

For those with reduced mobility, including the elderly and disabled, moving into and exiting from a typical bathtub can be difficult. Most bathtubs include a raised wall used to contain the water within the bathtub interior. This wall presents an obstacle for some users as it requires the user to step over the wall to enter the bath. This can be difficult and even dangerous for those with reduced mobility from injury or impairment, as the user has to step over the bathtub wall one leg at a time while maintaining balance on a single foot. While this is readily accomplished for one of normal health and strength, physical impairments and age can quickly diminish one's capacity to engage in such routine activities.

To improve the safety and reduce the burden of exiting and entering a bathtub for those with limited mobility, different types of walk-in bathtubs are available that assist stepping into and exiting from a bathtub interior that do not require the user to step over an obstacle. The ability to walk directly into the shower without lifting a leg or shifting one's weight drastically reduces the chances of injury, and further enables one to easily enter or exit the shower without straining or slipping. Generally these bathtubs include an open layout or a raised wall having an entry door therealong to provide through-access. The open layout design is mostly used in shower stall settings, while entry doors are disposed on fillable bathtubs structures.

While many walk-in bathtubs exist in the art and are readily available to consumers, these devices retain an inherent drawback that has to be resolved, Notably, when filling a walk-in bathtub with bath water, the door must be in a closed position in order to retain the water therein. Generally the door is lined with a seal or gasket to prevent water leakage therethrough from the tub interior. When in a closed position, the door supports the pressure exerted on the door interior and the tub can be filled for the user to soak in the tub interior as desired.

This arrangement, while useful for providing an entryway into the tub, does not allow the user to first set the bathtub by filling the same and bringing the bath water to an appropriate temperature before entering thereinto. If the user desires to set the water before entering the bathtub, the door must be a closed position and the tub therefore returns to a traditional tub arrangement with a uniform outer wall for the user to climb over. This defeats the purpose of the entry door and therefore makes the exercise of first setting the tub not feasible for those with mobility problems who may require a walk-in arrangement in the first place.

The present invention is submitted as a new and novel walk-in bathtub arrangement that serves a long-felt need in the art. Specifically, the present invention contemplates a walk-in bathtub that is capable of being set before the user enters thereinto, wherein the user can fill the tub interior, place desired soaps and treatments into the water, and ensure a desired water temperature before being in the tub. The bathtub includes a removable dam element that segments the tub interior into a first and second compartment, whereby the first compartment can be filled while the second compartment acts as an operable entryway, operable seating area, or water-fillable compartment after the bathwater in the first compartment is set. This allows the user to set the bathwater prior to entry thereinto without being forced to close the entry door, while two separate drains and dam element allow the user to exit the tub from the second compartment while the first compartment is still being drained.

2. Description of the Prior Art

Devices have been disclosed in the prior art that relate to walk-in bathtub arrangements and entry doors therefor. These include devices that have been patented and published in patent application publication, and generally relate to different tub arraignments, those with operable entry doors, and other with interior seat accommodations. The following is a list of devices deemed most relevant to the present disclosure, which are herein described for the purposes of highlighting and differentiating the unique aspects of the present invention, and further highlighting the drawbacks existing in the prior art.

One such device in the prior art is U.S. Pat. No. 7,299,509 to Neidich, which discloses a door assembly for a walk-in bathtub, wherein the device comprises a first track that accommodates a gasket along the length of the door frame, and a second track for mounting the door hinge. The gasket forms a tight seal between the door and the walk-in bathtub, whereby the door will not leak fluid when the tub is filled with water. While teaching a novel door for a walk-in bathtub and disclosing a bathtub of the walk-in type, the Neidich device fails to teach the novel configuration of the present invention, which provides a user with flexibly with regard to preparing, entering, and thereafter using the walk-in bathtub.

Similar to the Neidich device, U.S. Pat. No. 8,375,478 to Luo discloses a walk-in bathtub having a bathtub frame, a door jamb, a hingedly attached door attached to the door jamb, and a gasket disposed between the door and door jamb to prevent leaks therefrom. To secure the door to the door jamb, and thus create a flush seal that encloses the tub water within the bathtub frame, a movable handle and latching pin secure the door against the gasket. The Luo device, similar to the Neidich device, teaches of a new door and seal for a walk-in bathtub, and fails to disclose the novel operating functions and structural elements of the present invention.

Further related to walk-in bathtub doors is U.S. Patent Publication No. 2010/0263119 to Neidich, which describes a door assembly having a first and second door mount to provide a double axis hinge for the door connecting to the bathtub threshold. The double axis hinge allows the door to be removed from its closed position and placed in a position that faces the interior of the door towards the bathtub when in an open position, rather than a single hinge door that swing open in an arcing fashion. Similar to the aforementioned devices related to walk-in bathtub doors, the Neidich double axis door does not contemplate the novel features of the present invention and is limited to a new door type for walk-in bathtubs.

Finally, U.S. Patent No. 2005/0102746 to Wright discloses a walk-in bathtub that includes a unitary body forming an elevated seat portion and a lower floor region. A water-tight door is fitted to a door frame on the unitary body and adjacent to the lower floor region, whereby water can be filled into the floor region for the user to bath. A drain hole is positioned on the lower floor region to drain the bathwater between users and to allow for opening the door. The Wright device discloses a seated bathtub having a seat portion and lower leg portion. The Wright device is not capable of filling until the user has entered the bathtub and closed the water-tight door. The present invention contemplates an assembly that allows the user to fill the bathtub with water and prepare the same at a given temperature before entering for bathing activities. The user can freely enter and exit the bathtub, whereby a dam element prevents water from entering the back portion of the tub and pressing against the entry door.

The present invention provides a walk-in bathtub that allows the tub to be first set and filled before the user enters the bathtub interior. The bathtub of the present invention can be utilized as a standup shower, as a soaking tub, or as a bathtub with an internal seat therein. Overall, the assembly provides an elderly or injured user with a more convenient means of taking baths or showers, whereby the bath can be filled and set prior to entry and the bathtub can be utilized in a number of different configurations.

It is submitted that the present invention is substantially divergent in design elements from the prior art, and consequently it is clear that there is a need in the art for an improvement to existing walk-in bathtub devices. In this regard the instant invention substantially fulfills these needs.

SUMMARY OF THE INVENTION

In view of the foregoing disadvantages inherent in the known types of walk-in bathtubs now present in the prior art, the present invention provides a new walk-in bathtub assembly that can be utilized for providing convenience for the user when setting a bath before entering the same, and further for using a walk-in bathtub as either a standup shower, a soaking tub, or a bathtub stall with interior seated support.

It is therefore an object of the present invention to provide a new and improved walk-in bathtub assembly that has all of the advantages of the prior art and none of the disadvantages.

It is another object of the present invention to provide a walk-in bathtub assembly that is useable as a standup shower, a seated bathtub stall, or a full soaking tub, while at the same time provide an entry door for walking directly into the bathtub interior.

Another object of the present invention is to provide a walk-in bathtub assembly that includes an interior dam element that allows a user to segment the bathtub into a first and second compartment, whereafter the first compartment may be filled prior to the user entering the bathtub or closing the entry door.

Yet another object of the present invention is to provide a walk-in bathtub assembly that includes a deployable seat from the second compartment, whereby the seat allows users to sit and wash themselves without fully entering the tub or standing.

Another object of the present invention is to provide a walk-in bathtub assembly that has an entry door that does not require users to lift their legs to enter the bathtub interior.

A final object of the present invention is to provide a walk-in bathtub assembly that may be readily fabricated from materials that permit relative economy and are commensurate with durability, wherein the assembly is built to the standard of walk-in bathtubs and will not leak when in a working state.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
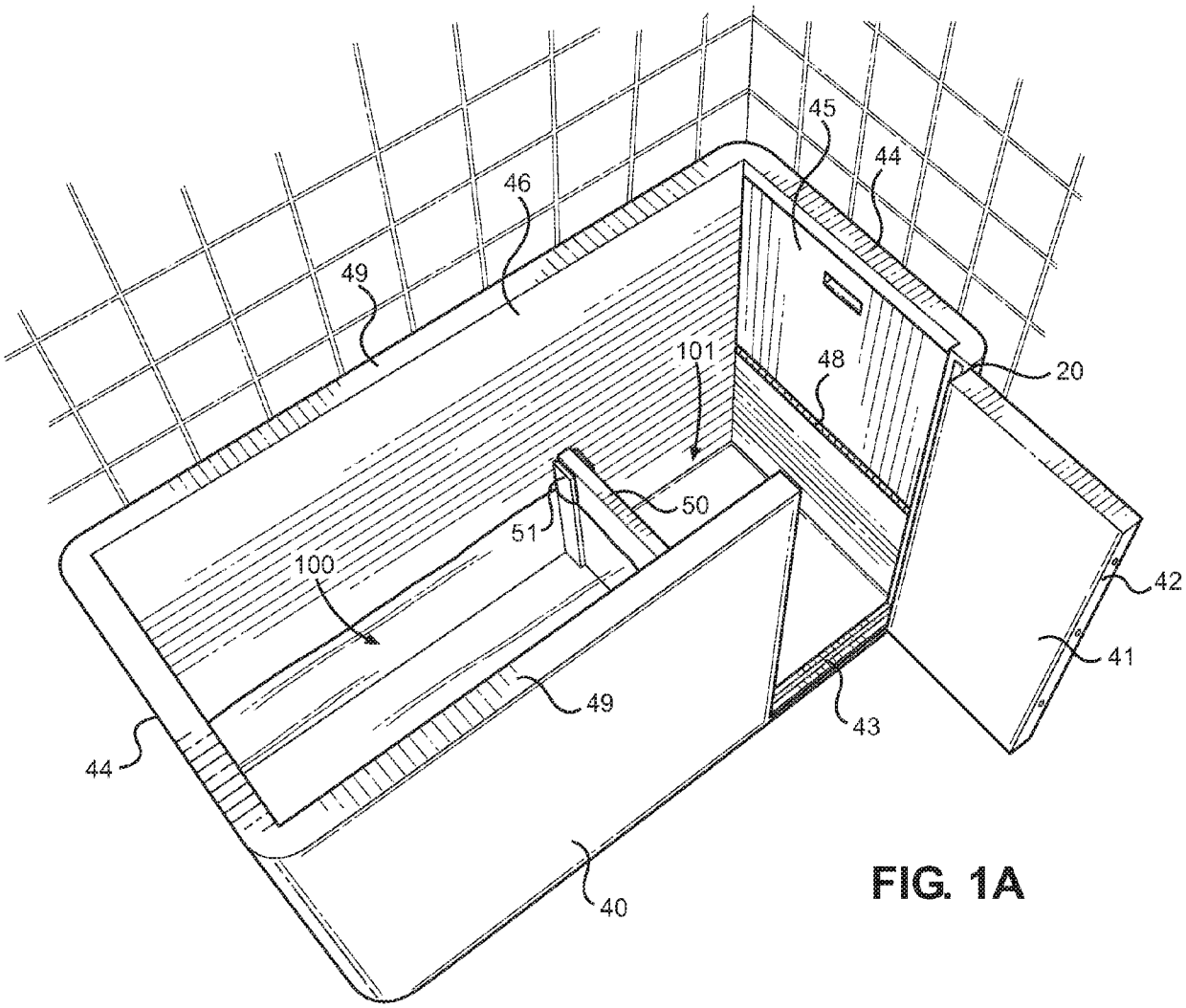
FIG. 1A shows an overhead view of the bathtub assembly of the present invention with the entry door in an open configuration and the first compartment filled with water.

Reference is made herein to the attached drawings. Like reference numerals are used throughout the drawings to depict like or similar elements of the walk-in bathtub assembly. For the purposes of presenting a brief and clear description of the present invention, the preferred embodiment will be discussed as used for providing a new and improved walk-in bathtub for the elderly or disabled. The figures are intended for representative purposes only and should not be considered to be limiting in any respect.

Referring now to FIG. 1A, there is shown an overhead perspective view of the walk-in bathtub of the present invention in a working state with its first compartment 100 filled with water for bathing, and the entry door 41 in an open configuration. The bathtub comprises an upstanding front wall 40, a pair of end walls 44, and a rear wall 49 that surround an open bathtub interior having a base surface. To facilitate entry into the bathtub interior, an entry door 41 is provided along the front wall 40 to allow entry therethrough without lifting one's legs. The door 41 pivots from the front wall 40 by way of a hinge joint 20, while the edges 42 of the door 41 align with a cutout in the front wall 40 when closed. Between the cutout and the door edges 42 is a seal or gasket 43 that prevents leaking therethrough. To secure the door 41 against the front wall 40, a handled latch (not shown) is provided to prevent the door 41 from freely swinging open during use.

Within the bathtub interior is a laterally extending dam element 50 that is adapted to segment the bathtub interior into a first 100 and second 101 compartment and prevent water communication between the compartments when fully installed. The dam element 50 is an operably installed member that preferably slides into defined slots 51 along the walls of the bathtub interior to lock the dam element 50 into place and secure the same against the walls of the bathtub interior. This element 50 allows users to fill the first compartment 100 of the bathtub interior while the second compartment 101 remains dry and free of water. In use, the user can fill the first compartment 100 with warm or hot water and set the water with soap or any other additives, all without having to secure the entry door 41 closed.

The ability to set the bath before closing the entry door 41 is a unique ability in the art of walk-in bathtubs, as the user generally has to first enter into the bathtub, seal the entry door, and then start the flow of water. The present invention allows a user to fill the first compartment 100 with warm water and prepare it for use without physically entering the bathtub interior or sealing the entry door 41 closed against the outer wall 40.

Figure 1B:
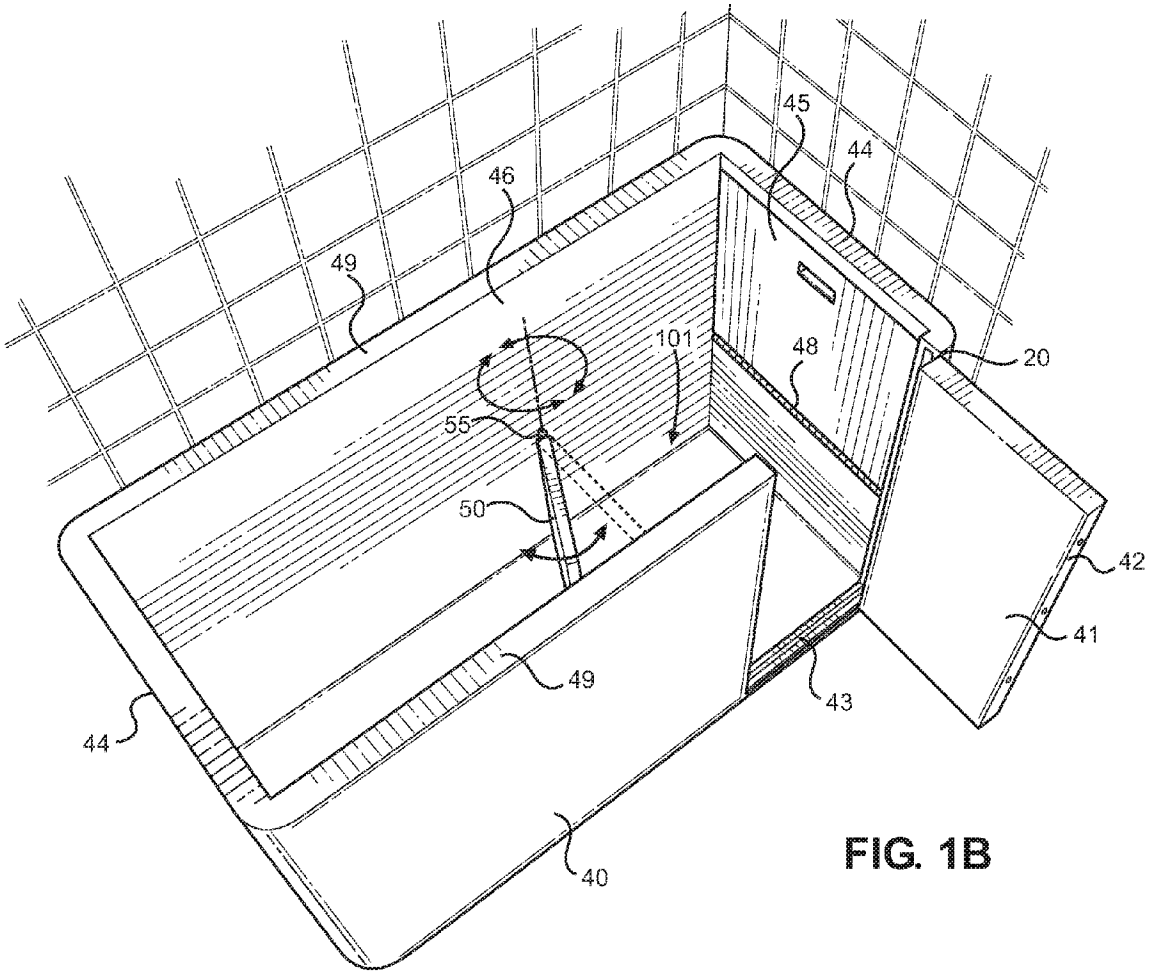
FIG. 1B shows an overhead view of a second embodiment of the bathtub assembly.
Figure 2:
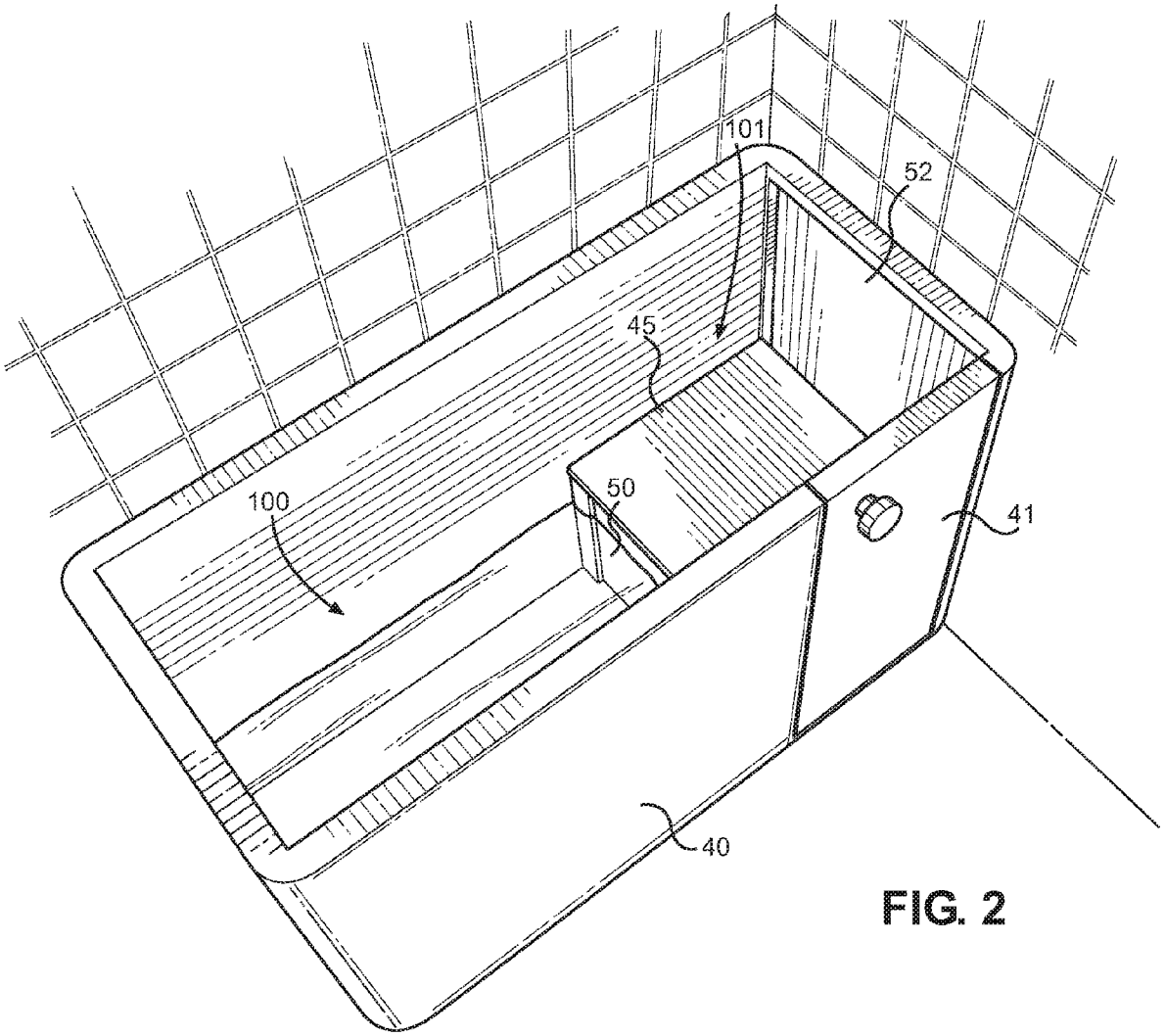
FIG. 2 shows another overhead view of the bathtub assembly of the present invention in a working state, wherein the deployable seat is in a downward position for use as a seated support within the bathtub interior.

Referring now to FIGS. 1A, 1B, and 2, the deployable seat 45 of the present invention is shown in a stowed configuration and in a deployed state. The deployable seat 45 is a hinged 48 support surface that is mounted to the rear end wall 44 of the bathtub and can pivot between an upright (stowed) position, and a horizontal (working) position. The seat 45 is preferably positioned within the second compartment 101 of the bathtub interior and allows the user to set the water in the first compartment 100 and rest on the seat 45 for washing oneself in a seated position. The user can further fill the first compartment 100, enter the second compartment 101 while the seat 45 is stowed, closed the entry door 41, and then deploy the seat 45 for resting on the same.

The seat 45 is supported along the bathtub interior such that the weight of the user is supported during use. The outer edge of the seat 45 may rest against the upper portion of the dam element 50, as shown in FIG. 2, or alternatively the seat 45 may not extend outward to the extent of the dam element 50 position. In this alternative, the user has room to place his or her legs between the dam element 50 and the seat 45 without removing the dam element 50. If the seat rests against the dam element 50, the user can step over the dam element 50, supporting himself along the upper edge 49 of the bathtub sides for support. Thereafter the user can wash himself while seated using water prepared in the first compartment 100. To assist the user during this motion, hand rails may be provided for the user to grasp along the shower sides (not shown).

Referring specifically to FIG. 1B, an alternate configuration for the dam element 50 and its attachment to the interior walls of the bathtub includes a hinged configuration. In this embodiment, the dam element 50 is secured across the bathtub interior when deployed and does not let water pass therethrough, while the dam element can be pivoted via a hinge joint 55 from a deployed state to a stowed state against the inner walls of the tub via a hinge joint along one side thereof. The hinge joint 55 allows the dam element 50 to swing into position or out of the way as desired by the user, and is submitted as an alternative to the slots 51 shown in FIG. 1A.

Figure 3:
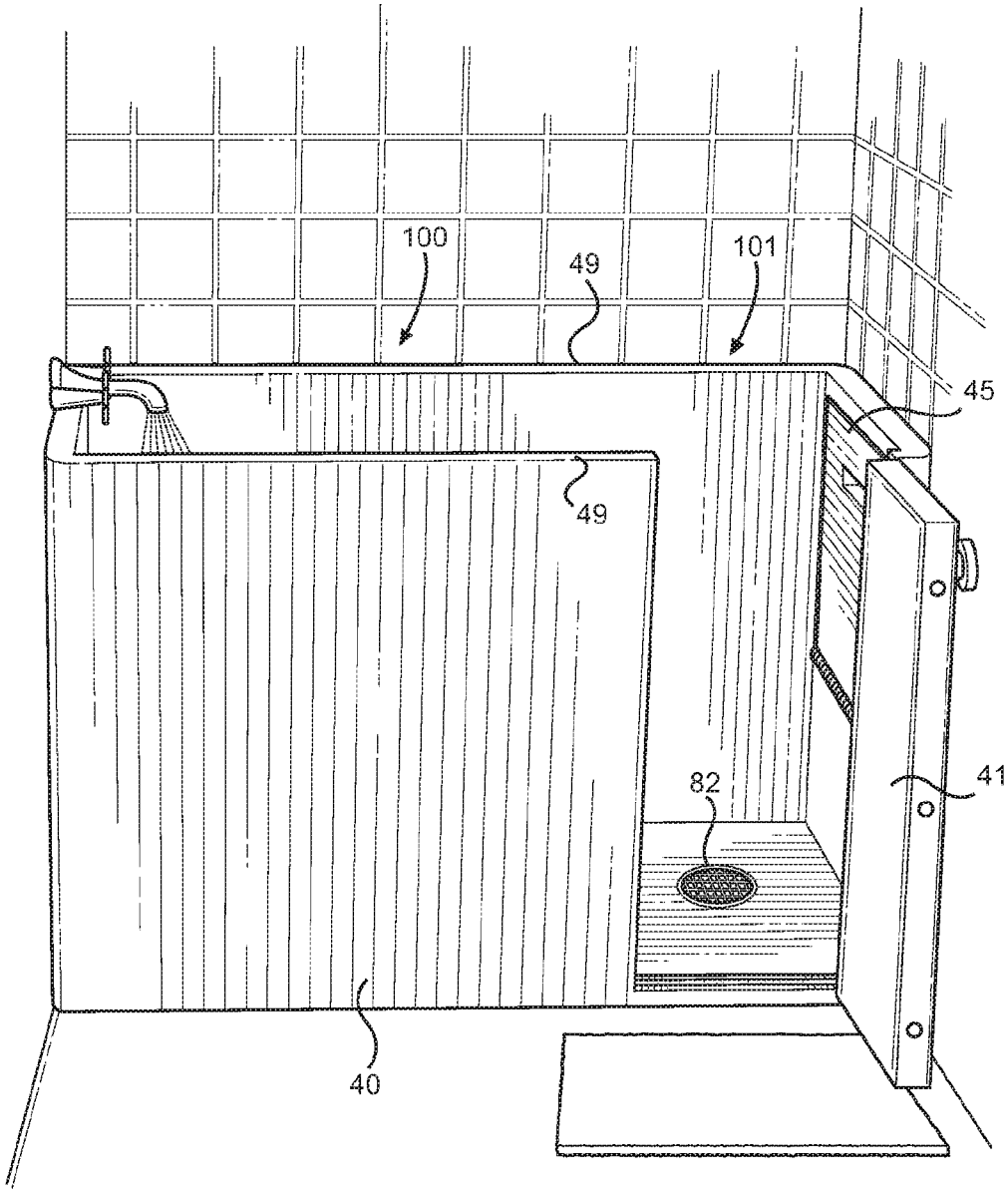
FIG. 3 shows a view of the outer wall of the walk-in bathtub and the entry door in an open configuration while filling the first compartment with water.

Referring now to FIG. 3, there is shown a view of the walk-in bathtub of the present invention being filled in the first compartment 100 while the second compartment 101 remains dry and the entry door 41 can be opened for ease of entry. When entering, the deployable seat 45 is positioned in a stowed state and the user can enter the cutout in the bathtub front wall 40 to enter the bathtub interior without stepping over any obstacles. Once in the bathtub interior, the user can close the entry door 41 and use the shower in a stand-up configuration, in a seated configuration, or the user can lift the dam element to fill the entire interior with bathing water for use as a soaking tub. Also shown in FIG. 3 is the second drain 82 positioned within the second compartment 101 of the bathtub. The bathtub comprises a first 81 and second 82 drain, wherein each is positioned in corresponding compartments for independently draining the same. When the dam element is in position, the first 100 and second 101 compartments drain independently, allowing a user to exit the second compartment 101 if that compartment has drained before the first compartment 100. This allows for quicker exiting without waiting for the entire tub to drain. Since the second compartment is a smaller volume, it will drain faster.

Figure 4:
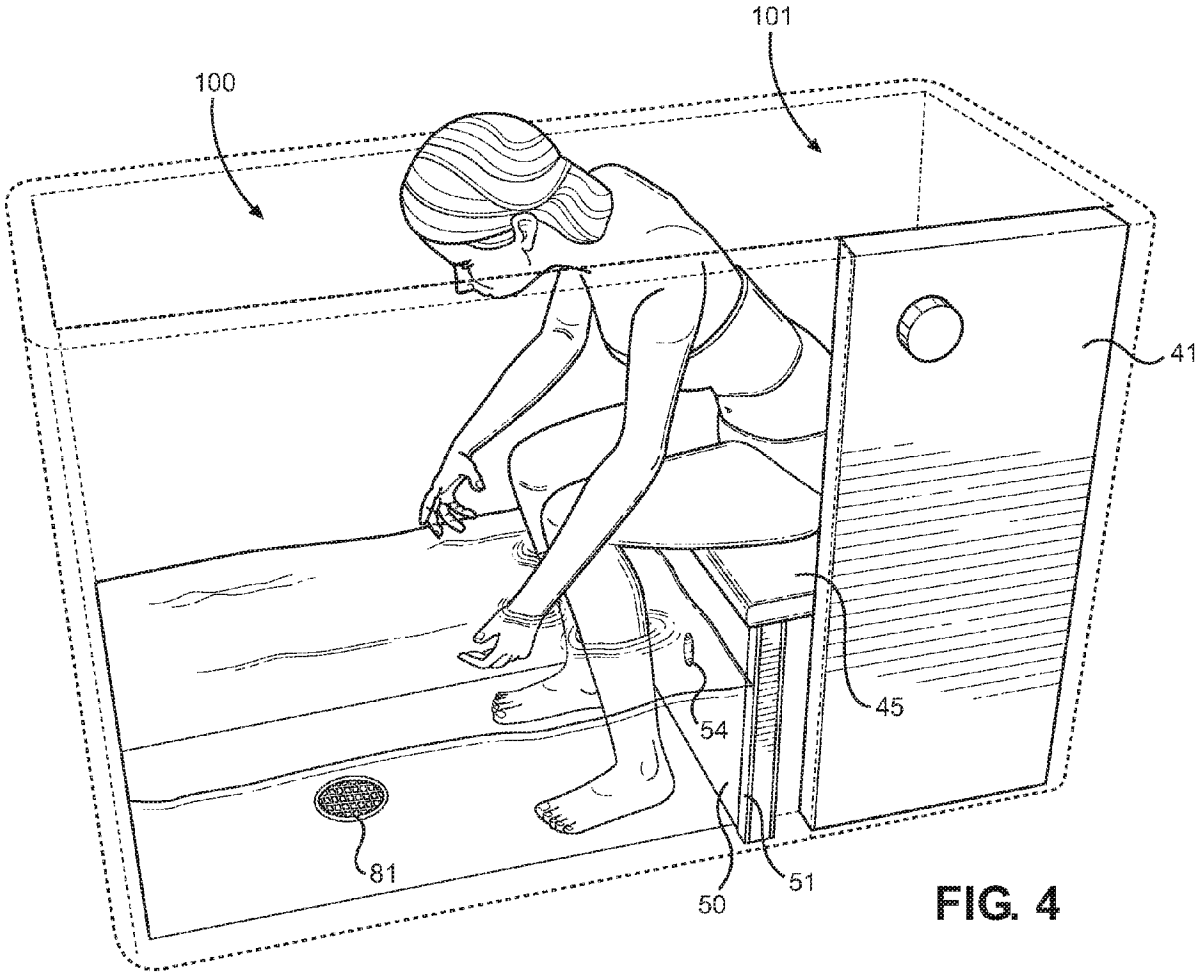
FIG. 4 shows a view of the walk-in bathtub assembly in use by a seated user.
Figure 5:
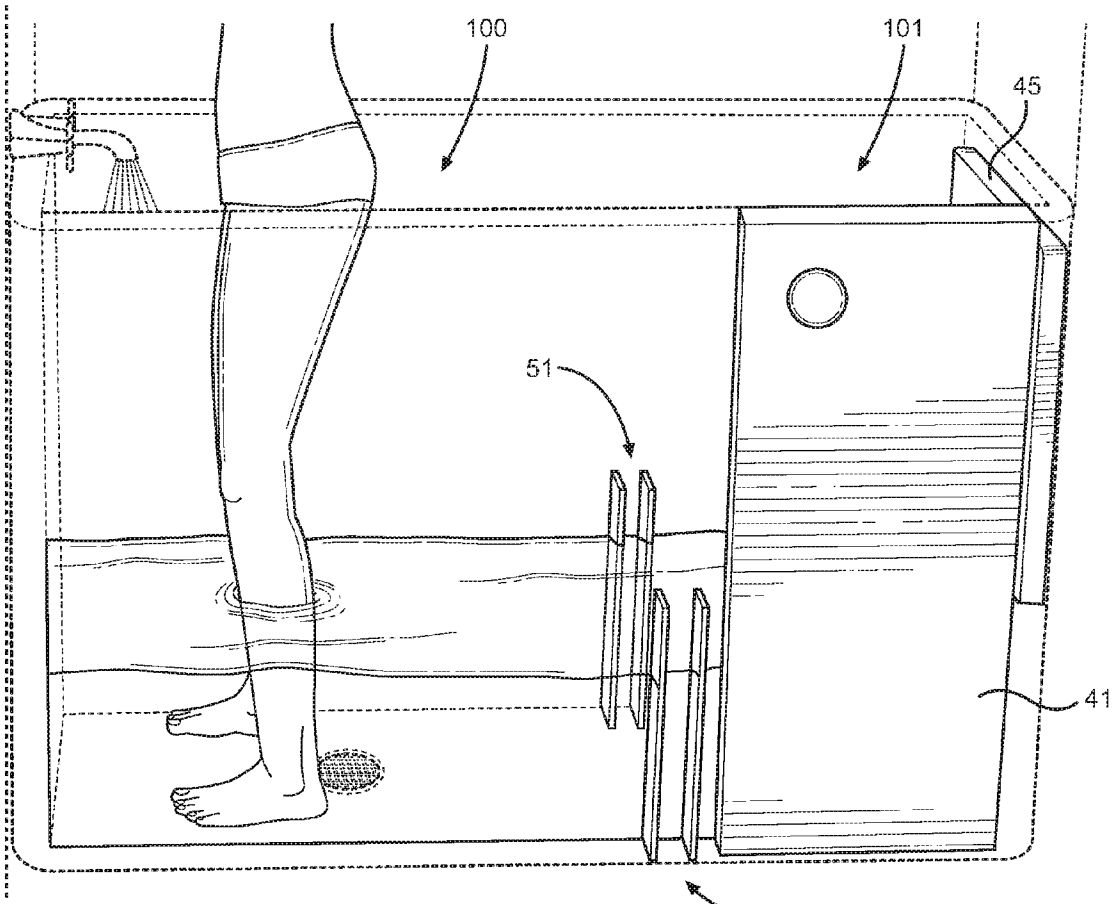
FIG. 5 shows a view of the walk-in bathtub assembly in use by a standing user.

Referring now to FIGS. 4 and 5, there are shown views of the walk-in bathtub of the present invention in a working state, first in a seated state (FIG. 4), and then as a standing shower (FIG. 5). In a seated state, users can rest on the deployed seat 45 and bathe themselves with the water in the first compartment 100. If the user decides to use the entire tub and to soak therein, the user can stow the seat 45 and remove the dam element 50 to allow water to communicate from the first compartment 100 to the second compartment 101. It is contemplated that the dam element 50 be secured seated within slots 51 along the sides of the bathtub interior.

Also shown in FIG. 4 is a view of the first drain 81 positioned within the first compartment 100. As previously explained, the independent drains allow the bathtub compartments to drain at different rates, allowing a user to exit the second compartment 101 before the entire bathtub has drained to reduce waiting time during this period. It is further contemplated that the dam element may optionally include a fluid drain 54 and drainage plug for allowing water to communicate thereacross. This embodiment allows the user to equalize pressure on both sides of the dam 50 before lifting and removing the same. Yet another embodiment of the present invention is to provide a drain in both bathtub compartments for independent draining therefrom.

Figure 6B:
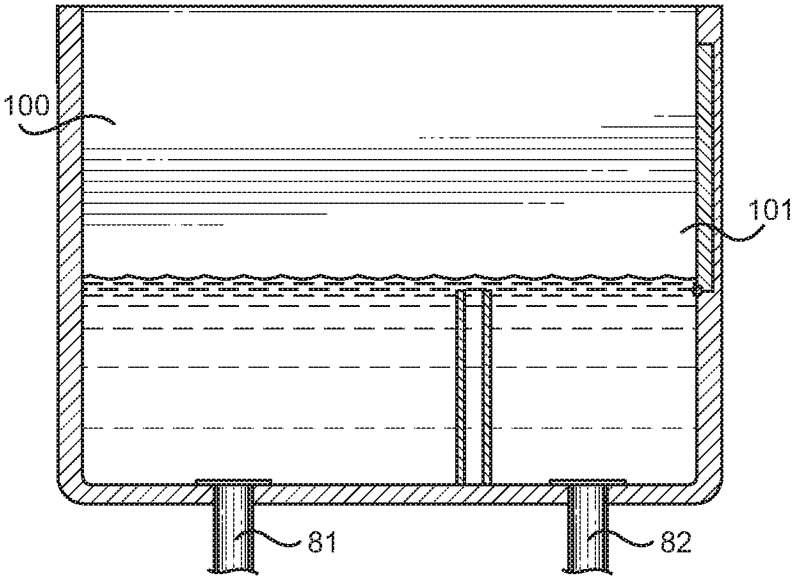
FIG. 6B shows a second cross section view after the user has entered the set bathtub and removed the central dam element to fill both compartments.
Figure 6A:
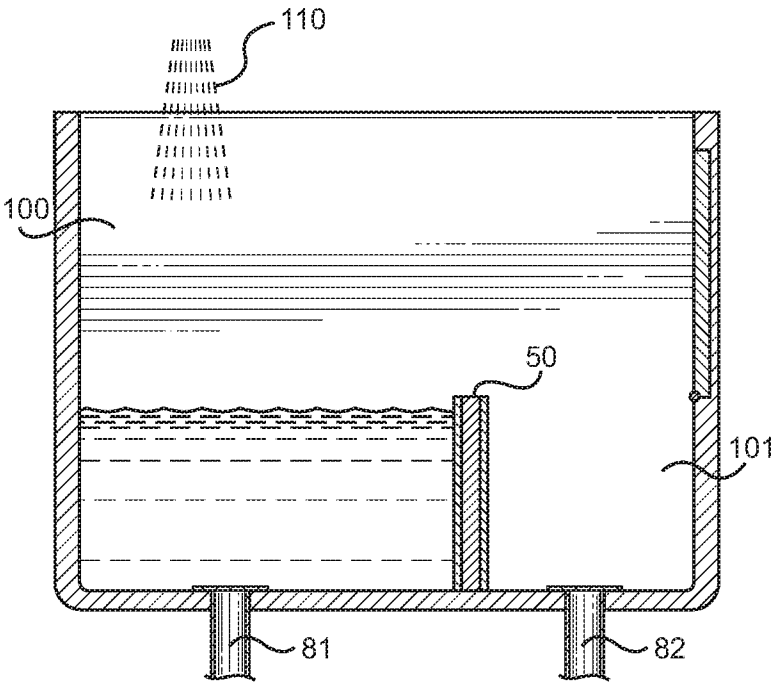
FIG. 6A shows a cross section of the present invention during the initial stages of the bathtub filling, wherein the first compartment is being filled and set prior to user entry.

Referring now to the cross section views, FIGS. 6A-6D, there is shown a sequence of views that illustrate filling and setting the bathtub, filling the entire bathtub interior for soaking, and then draining the bathtub using the independent drains. Referring specifically to FIG. 6A, this cross section view illustrates the initial stage of the bathtub filing, wherein the user has installed the dam element 50 between the first 100 and second 101 compartments of the bathtub and is filling the first compartment 100 with a water of desired temperature. The second compartment remains empty for the user to enter the bathtub without spilling any water contents from the first compartment 100. Once the first compartment 100 has been filled with water of a desired temperature and the user has entered the second compartment 101, the dam element is removed to fill the entire bathtub interior, as is shown in FIG. 6B.

Figure 6D:
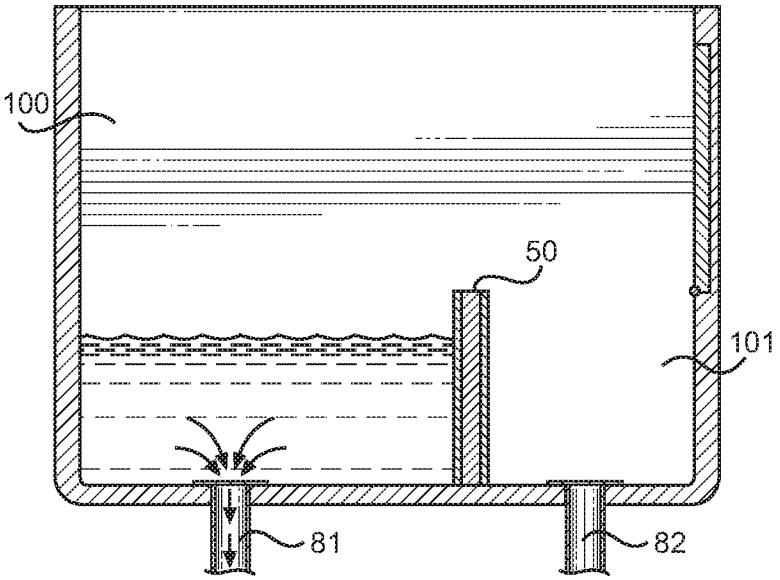
FIG. 6D shows a fourth cross section view of the tub being drained, wherein the dam element separates the first and second drains and allows the user to exit the second compartment even if the first compartment is still draining.
Figure 6C:
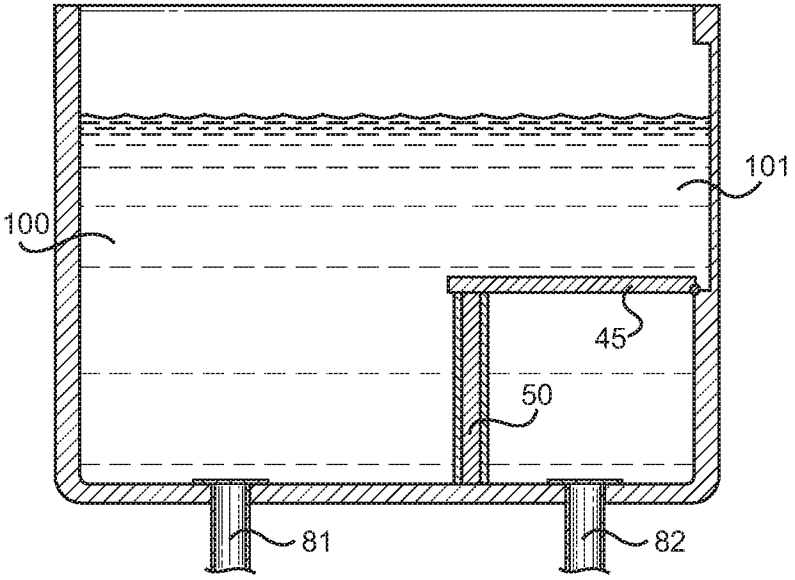
FIG. 6C shows a third cross section view of the bathtub being filled after the user has entered the tub, replaced the dam element, and placed the seat into a down position for seated bathing.

Once both compartments 100, 101 are filled, the water level in the bathtub can be raised to the desired level. If the user desires, the tub can be utilized as a soaking tub, wherein the dam element 50 is replaced and the seat 45 is deployed. The water level can be maintained below the level of the seat 45 or filled to the capacity of the bathtub for complete body soaking, as is shown in FIG. 6C. After the user has finished soaking or bathing, the seat 45 is stowed and the dam element 50 is installed for draining the first 100 and second 101 compartments individually. The first 81 and second 82 drains then drain the compartments independently. To reduce the wait time for the user during the draining phase, the second compartment 101 is sized slightly smaller than the first compartment 100 to allow for swifter draining through the second drain 82. This allows the user to exit from the second compartment 101 through the entry door before the entire tub is drained, as is shown in FIG. 6D. Therefore, the present invention offers a user a unique method of first setting the bathtub and thereafter draining the same when the user desires to exit the same.

Overall, the bathtub of the present invention is configured to allow preparation of the bathwater before entry thereinto, while also facilitating use of the tub in several different configurations. The size, shape, and materials of the bathtub may take on several forms, falling within the scope of the functional elements of its use and for providing a sealed, comfortable bathtub for use while standing, seated, or while soaking.

Senior citizens and those with joint pain, injuries or physical disabilities may struggle to step into a standard bathtub. Existing walk-in bathtubs require the individual to stand or sit inside the tub while it fills, and again as it drains. This process wastes the person's time and can leave the individual feeling cold and uncomfortable. The present invention describes a new walk-in bathtub assembly. The assembly comprises a walk-in bathtub that has an internal dam element that divides the tub interior into two distinct compartments. A user can fill the first compartment without having to be inside the tub while waiting for the water to fill. Once the water reaches a desired level and temperature, the user can enter the secondary compartment, disrobe and release the dam, which will in turn fill the secondary compartment. The user can alternatively deploy the seat for use of the first compartment water without releasing the dam and without remaining in a standing position. Finally, the user can choose to use the bathtub assembly as a standard shower tub for upright cleaning.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A walk-in bathtub, comprising:

bathtub sidewalls, a base surface, and an open bathtub interior between said bathtub sidewalls and said base surface;

a cut-out through one of said bathtub sidewalls adapted to allow a user to step therethrough and into said bathtub interior;

an entry door attached to said cutout, said entry door adapted to operably seal said cutout and prevent leaks when in closed state thereagainst;

a removable dam element within said bathtub interior, said dam element separating said bathtub interior into a first and second compartment;

said dam element adapted to prevent water from communicating between said first and second compartment when installed;

a faucet for filling said bathtub interior, said faucet located over said first compartment;

a first drain adapted for draining said bathtub interior;

a deployable seat from said second compartment, said deployable seat configured to rest against an upper edge of said dam element when deployed.

2. The walk-in bathtub of claim 1, wherein said deployable seat is hinged to said bathtub sidewalls and is pivotable from an upstanding, stowed state to a horizontal, deployed state.

3. The walk-in bathtub of claim 1, wherein said dam element further comprises a fluid drain for operably communicating fluid from said first compartment to said second compartment.

4. The walk-in bathtub of claim 1, wherein said dam element is slidably positioned into opposing slots within said bathtub interior that support said dam element against said base surface and said sidewalls.

5. The walk-in bathtub of claim 1, wherein said dam element is hingedly attached within said bathtub interior.

6. The walk-in bathtub of claim 1, wherein said first drain is positioned within said first compartment, and a second drain is positioned within said second compartment.

7. The walk-in bathtub of claim 1, wherein said sidewalls further comprise an upstanding front wall, a pair of end walls, and a rear wall that surround said bathtub interior.

8. The walk-in bathtub of claim 1, wherein said first compartment comprises a larger volume than said second compartment volume within said bathtub interior.

9. The walk-in bathtub of claim 1, wherein said deployable seat is hinged to an end wall and is pivotable from an upstanding, stowed state to a horizontal, deployed state.

10. The walk-in bathtub of claim 1, wherein said dam element further comprises a fluid drain for operably communicating fluid from said first compartment to said second compartment when installed.

11. A walk-in bathtub, comprising:

bathtub sidewalls, a base surface, and an open bathtub interior between said bathtub sidewalls and said base surface;

a cut-out through one of said bathtub sidewalls adapted to allow a user to step therethrough and into said bathtub interior;

an entry door attached to said cutout, said entry door adapted to operably seal said cutout and prevent leaks when in closed state thereagainst;

a removable dam element within said bathtub interior, said dam element separating said bathtub interior into a first and second compartment;

said dam element adapted to prevent water from communicating between said first and second compartment when installed;

a faucet for filling said bathtub interior, said faucet located over said first compartment;

a first drain adapted for draining said bathtub interior;

a deployable seat from said second compartment, wherein an outer edge of said deployable seat is offset from an upper edge of said dam element when deployed, whereby said offset is adapted to create legroom between said deployable seat when deployed and said dam element.

* * * * *